US009139404B2

(12) United States Patent
Inada et al.

(10) Patent No.: US 9,139,404 B2
(45) Date of Patent: Sep. 22, 2015

(54) RAISABLE-LOWERABLE MEMBER

(71) Applicant: KOBELCO CRANES CO., LTD., Shinagawa-ku (JP)

(72) Inventors: Keiko Inada, Hyogo (JP); Hitoshi Kurotsu, Hyogo (JP); Daisuke Takaoka, Hyogo (JP); Yasuo Ichikawa, Hyogo (JP); Eiji Miya, Hyogo (JP)

(73) Assignee: KOBELCO CRANES CO., LTD., Shinagawa-ku (JP)

( * ) Notice: Subject to any disclaimer, the term of this patent is extended or adjusted under 35 U.S.C. 154(b) by 41 days.

(21) Appl. No.: 14/211,034

(22) Filed: Mar. 14, 2014

(65) Prior Publication Data

US 2014/0263140 A1 Sep. 18, 2014

(30) Foreign Application Priority Data

Mar. 18, 2013 (JP) ..... 2013-055367

(51) Int. Cl.
*B66C 23/70* (2006.01)
*B66C 23/68* (2006.01)

(52) U.S. Cl.
CPC ..... *B66C 23/70* (2013.01); *B66C 23/68* (2013.01)

(58) Field of Classification Search
CPC ..... B66C 23/005; B66C 23/04; B66C 23/06; B66C 23/10; B66C 23/26; B66C 23/34; B66C 23/36; B66C 23/42; B66C 23/46; B66C 23/66; B66C 23/68; B66C 23/70
See application file for complete search history.

(56) References Cited

U.S. PATENT DOCUMENTS

| | | | | | |
|---|---|---|---|---|---|
| 3,685,668 | A * | 8/1972 | Suverkrop | ..... | 212/289 |
| 3,804,264 | A * | 4/1974 | Hedeen et al. | ..... | 212/295 |
| 4,383,616 | A * | 5/1983 | Sterner et al. | ..... | 212/299 |
| 4,473,214 | A * | 9/1984 | Sterner et al. | ..... | 254/415 |
| 4,529,094 | A | 7/1985 | Wadsworth | | |
| 2010/0243595 | A1 * | 9/2010 | Walker et al. | ..... | 212/294 |
| 2010/0294736 | A1 * | 11/2010 | Wernecke et al. | ..... | 212/293 |
| 2012/0175333 | A1 * | 7/2012 | Pech et al. | ..... | 212/177 |
| 2014/0353272 | A1 * | 12/2014 | Nakamura et al. | ..... | 212/177 |

FOREIGN PATENT DOCUMENTS

| | | | | |
|---|---|---|---|---|
| JP | 60-61496 | | 4/1985 | |
| JP | 10157982 | A * | 6/1998 | ..... B66C 23/70 |

* cited by examiner

*Primary Examiner* — Emmanuel M Marcelo
(74) *Attorney, Agent, or Firm* — Oblon, McClelland, Maier & Neustadt, L.L.P.

(57) ABSTRACT

Disclosed is a raisable-lowerable member which comprises a boom and a jib. The boom comprises a first supporting portion configured to rotatably support a jib foot when the jib is set in a protruding posture; and a second supporting portion configured to rotatably support a supportable portion of the jib when the jib is set in an enfolded posture. A position adjusting and holding unit of the jib is configured to couple, to the frame, a specific site of the second link in such a manner that a relative position of the second link with respect to the frame in a rotational direction of the second link is adjustably changed to allow the rotational axis of the second joint portion to become coincident with the rotational axis of the jib foot, and to hold the second link at the changed relative position.

7 Claims, 7 Drawing Sheets

RAISABLE-LOWERABLE MEMBER

BACKGROUND OF THE INVENTION

1. Field of the Invention

The present invention relates to a raisable-lowerable member designed to be provided in a construction machine.

2. Background Art

Heretofore, there has been known a raisable-lowerable member designed to be provided in a construction machine. One example of such a raisable-lowerable member is disclosed, for example, in JP 60-061496A. A raisable-lowerable member disclosed in this patent publication comprises a boom, and a jib attached to the boom in such a manner as to be raisable and lowerable with respect to the boom. The jib disclosed in the patent publication is an enfolding support-type jib. As an axis of rotation of the enfolding support-type jib with respect to the boom, the jib has two rotational axes. A first one of the two rotational axes is a rotational axis during a crane work (see the reference code "F-1, B-1" in FIG. 5 of the patent publication). The first rotational axis corresponds to a rotational axis of a jib foot. The other, second, rotational axis is a rotational axis during a crane disassembling/reassembling operation (see the reference code "F-2, B-2" in FIG. 6 of the patent publication). The second rotational axis is a rotational axis of a support portion of the jib to be supported by the boom when the jib is set in an enfolded posture. The jib has two rotational axes in this manner, so that it becomes possible to suppress a bending moment which would otherwise be produced in the boom during a crane work, and allow the jib to be set in the enfolded posture (in a posture where the jib is disposed under the boom which has been lowered and laid down) during a crane disassembling/reassembling operation. Furthermore, based on the capability to allow the jib to be set in the enfolded posture, a space necessary for a crane disassembling/reassembling operation is minified.

The enfolding support type jib is equipped with an enfolding link mechanism (enfolding articulated mechanism) for coupling the jib and the boom together (see the reference codes 47, 49 in FIGS. 5 to 7 of the patent publication). The enfolding link mechanism comprises a first link (see the reference code 49 in FIG. 5 of the patent publication) rotatable about an axis coincident with a rotational axis of the jib foot, and a second link (see the reference code 47 in FIGS. 6 and 7 of the patent publication) rotatable about an axis coincident with a rotational axis of the support portion.

In the above conventional raisable-lowerable member, in order to attach the second link to the boom, it is necessary to positionally align a central axis of a distal end of the second link with a central axis of the jib foot (the details will be described later). That is, in the conventional raisable-lowerable member, during this operation, the distal end of the second link has to be moved by using an auxiliary crane or the like. For example, the distal end of the second link has to be moved up and down by using an auxiliary crane or the like. This gives rise to a problem that an attaching operation of the second link to the boom takes a lot of time and effort.

SUMMARY OF THE INVENTION

It is an object of the present invention to provide a raisable-lowerable member capable of making it easier to perform an operation of attaching, to a boom, a link (second link) rotatable about an axis coincident with a rotational axis of a supportable portion of a jib to be supported by the boom when the jib is set in an enfolded posture.

According to one aspect of the present invention there is provided a raisable-lowerable member designed to be provided in a construction machine. The raisable-lowerable member comprises a boom, and a jib attachable to a tip end of the boom. The jib comprises: a frame; a jib foot provided at one end of the frame constituting a base end of the jib, and configured to be supported by the boom in a rotatable manner with respect to the boom when the jib is set in a protruding posture where it protrudes from the tip end of the boom; a supportable portion provided in the frame, and configured to be supported by the boom in a rotatable manner with respect to the boom when the jib is set in an enfolded posture where it extends from the tip end of the boom toward a base end of the boom along a belly surface of the boom; a first link coupled to the frame in a rotatable manner about a first axis coincident with a rotational axis of the jib foot; a second link coupled to the frame in a rotatable manner about a second axis coincident with a rotational axis of the supportable portion; and a position adjusting and holding unit for adjusting a relative position of the second link with respect to the frame. The first link has a first joint portion which is provided at a position away from the rotational axis of the first link and is attachable and detachable with respect to the boom, and the second link has a second joint portion which is provided at a position away from the rotational axis of the second link, and is attachable and detachable with respect to the boom. The boom comprises: a first supporting portion provided at the tip end of the boom, and configured to rotatably support the jib foot when the jib is set in the protruding posture; a second supporting portion provided at a position away from the first supporting portion and toward the belly surface of the boom, and configured to rotatably support the supportable portion when the jib is set in the enfolded posture; and a third supporting portion configured to detachably support the second joint portion in such a manner as to allow the second joint portion to be rotated about an axis coincident with the rotational axis of the jib foot being supported by the first supporting portion. The position adjusting and holding unit is configured to couple, to the frame, a specific site of the second link away from the second axis, in such a manner that a relative position of the second link with respect to the frame in a rotational direction of the second link is adjustably changed to allow the rotational axis of the second joint portion to become coincident with the rotational axis of the jib foot, and to hold the second link at the changed relative position.

DETAILED DESCRIPTION OF THE EMBODIMENTS OF THE INVENTION

With reference to FIGS. 1 to 7B, a crane 1 equipped with a raisable-lowerable member 6 according to one embodiment of the present invention will be described.

Figure 1:
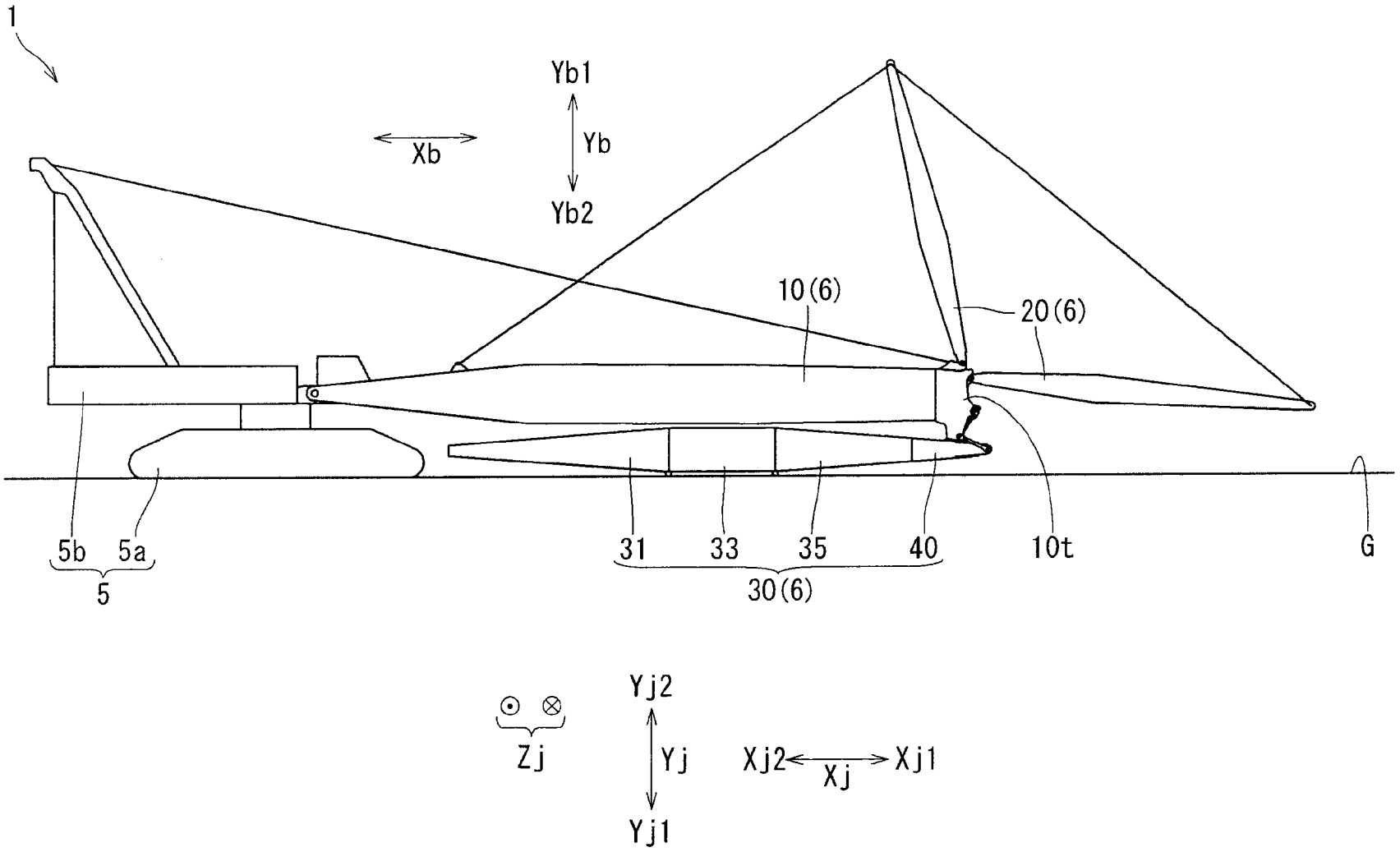
FIG. 1 is a schematic side view illustrating a construction machine using a raisable-lowerable member according to one embodiment of the present invention.

As illustrated in FIG. 1, the crane 1 is a construction machine equipped with the raisable-lowerable member 6, such as a mobile crane. The crane 1 comprises a crane body 5 and the raisable-lowerable member 6.

The crane body 5 comprises a lower body 5*a* and an upper slewing body 5*b*. For example, the lower body 5*a* is a lower propelling body. Specifically, for example, the lower body 5*a* is a crawler type lower propelling body. The lower body 5*a* may be a wheel type lower propelling body. The upper slewing body 5*b* is attached to the lower body 5*a* in a slewable manner.

The raisable-lowerable member 6 is used for a crane work (hoisting work). The raisable-lowerable member 6 is provided in the crane body 5 in a raisable and lowerable manner. The raisable-lowerable member 6 comprises a boom 10, a strut 20 and a jib 30.

The boom 10 is attached to the upper slewing body 5*b* of the crane body 5 in a raisable and lowerable manner. The boom 10 is, for example, a rod-type structural body having a lattice structure or the like (such as a lattice boom). The point that an applicable structural body is, for example, a rod-type structural body having a lattice structure or the like, also applies to the strut 20 and the jib 30. In the following description, an axial direction of the boom 10 will be referred to as "boom axis direction Xb". An upward-downward direction of the boom 10 in a state in which the boom 10 is lowered and laid down (in a state in which the boom axis direction Xb and the ground surface G are parallel to each other or approximately parallel to each other) will be referred to as "boom upward-downward direction Yb". A back (reverse) surface side of the boom 10 in the boom upward-downward direction Yb will be referred to as "boom back surface side Yb1". That is, an upper surface side of the boom 10 in the state in which the boom 10 is lowered and laid down in such a manner as to allow the boom axis direction Xb and the ground surface G to become parallel to each other or approximately parallel to each other (in a laid-down state of the boom 10) will be referred to as "boom back surface side Yb1". A belly surface side of the boom 10 in the boom upward-downward direction Yb will be referred to as "boom belly surface side Yb2". That is, a lower surface side of the boom 10 in the state in which the boom 10 is lowered and laid down in such a manner as to allow the boom axis direction Xb and the ground surface G to become parallel to each other or approximately parallel to each other (in the laid-down state of the boom 10) will be referred to as "boom belly surface side Yb2". The boom 10 has a base end attached to the upper slewing body 5*b* and a tip end (hereinafter referred to as "boom tip end 10*t*") on a side opposite to the base end.

Figure 2:
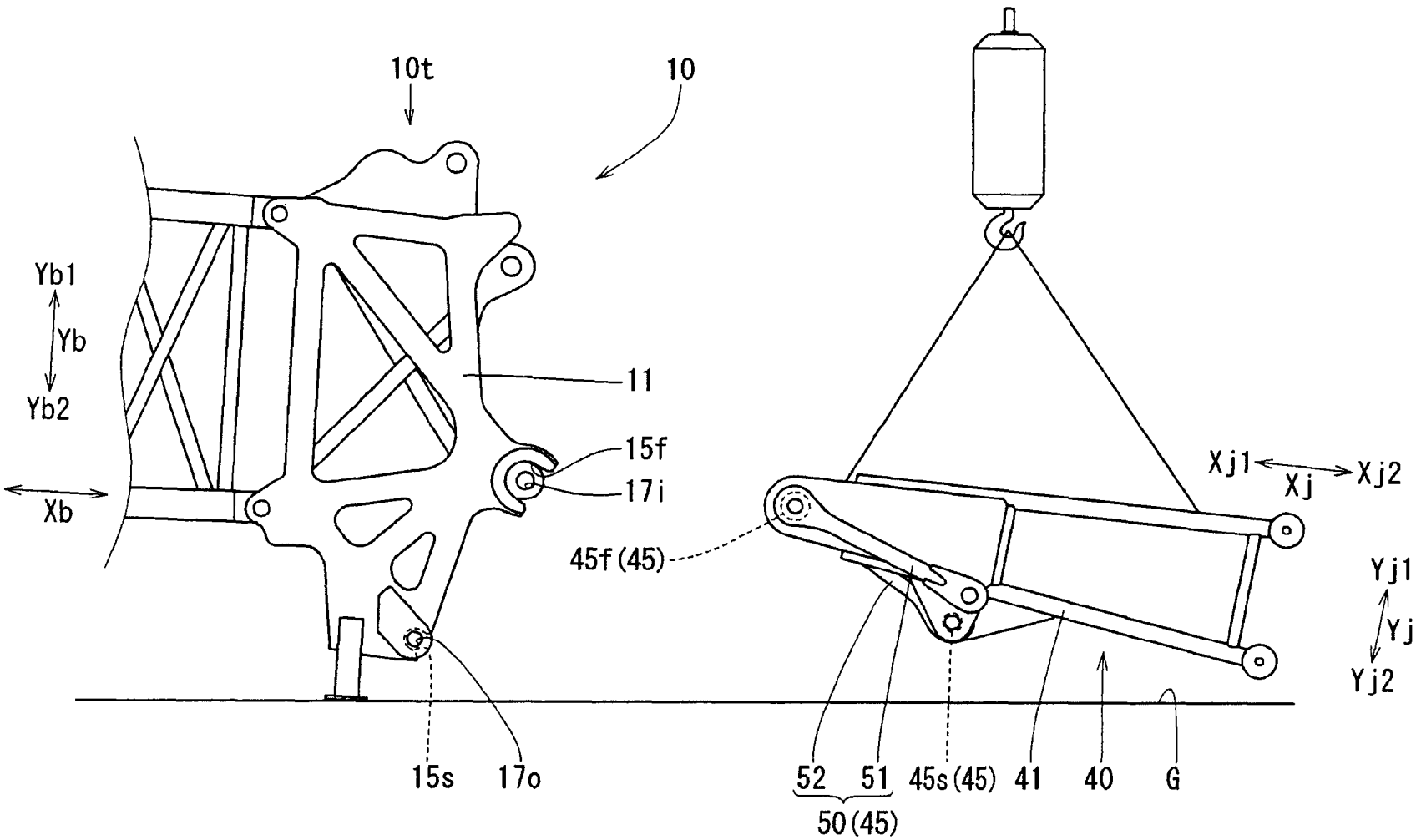
FIG. 2 is a diagram illustrating a boom tip end 10*t* of a boom 10 and a lower jib 40 of the construction machine illustrated in FIG. 1.

The boom tip end 10*t* is configured to be adaptable to the enfolding support type. As illustrated in FIG. 2, the boom tip end 10*t* comprises a boom tip frame 11, a boom-side jib foot 15*f*, a boom-side supporting portion 15*s*, an inner-link mounting bracket 17*i*, and an outer-link mounting bracket 17*o*.

The boom-side jib foot 15*f* and the boom-side supporting portion 15*s* are provided in the boom tip frame 11 (boom tip end 10*t*). The boom-side jib foot 15*f* is one example of "first supporting portion" set forth in the appended claims, and the boom-side supporting portion 15*s* is one example of "second supporting portion" set forth in the appended claims. Each of the boom-side jib foot 15*f* and the boom-side supporting portion 15*s* has an opening such as a U-shaped opening. That is, each of the boom-side jib foot 15*f* and the boom-side supporting portion 15*s* is formed with an opening having a mouth opened in a part of a periphery thereof. Alternatively, each of the boom-side jib foot 15*f* and the boom-side supporting portion 15*s* may be a columnar-shaped member. In either case, the boom-side jib foot 15*f* is configured to rotatably support an aftermentioned jib-side jib foot 45*f* when the jib 30 is set in an aftermentioned protruding posture. Specifically, the boom-side jib foot 15*f* is configured to support the jib-side jib foot 45*f* in such a manner as to allow the jib-side jib foot 45*f* to be rotated about an axis extending in an aftermentioned jib lateral direction Zj. The boom-side jib foot 15*f* is also configured to, when an aftermentioned lower jib 40 is attached to the boom tip end 10*t*, support the jib-side jib foot 45*f* in such a manner as to allow the lower jib 40 to be rotated about an axis extending in the aftermentioned jib lateral direction Zj. On the other hand, the boom-side supporting portion 15*s* is configured to, when the jib 30 is set in an aftermentioned enfolded posture (see FIG. 1), rotatably support an aftermentioned jib-side supporting portion 45*s*. Specifically, the boom-side supporting portion 15*s* is configured to support the jib-side supporting portion 45*s* in such a manner as to allow the jib-side supporting portion 45*s* to be rotated about an axis extending in the aftermentioned jib lateral direction Zj. The boom-side jib foot 15*f* is disposed at a position closer to a central axis of the boom 10 than the boom-side supporting portion 15*s*, i.e., disposed on the boom back surface side Yb1 with respect to the boom-side supporting portion 15*s*. In other words, the boom-side supporting portion 15*s* is provided at a position away from the boom-side jib foot 15*f* and toward the boom belly surface side Yb2.

The inner-link mounting bracket 17*i* and the outer-link mounting bracket 17*o* are provided in the boom tip frame 11 (boom tip end 10*t*). The inner-link mounting bracket 17*i* is one example of "third supporting portion" set forth in the appended claims. Each of the inner-link mounting bracket 17*i* and the-outer link mounting bracket 17*o* has a pin hole. The pin hole of the inner-link mounting bracket 17*i* is disposed in concentric (coaxial) relation to the boom-side jib foot 15*f*. The pin hole of the outer-link mounting bracket 17*o* is disposed in concentric (coaxial) relation to the boom-side supporting portion 15*s*.

The strut 20 (see FIG. 1) is connected to the jib 30 via a wire rope (not illustrated). The strut 20 is operable, when the wire rope is pulled and tightened, to cause the jib 30 to be raised with respect to the boom 10, and, when the wire rope is loosened, to cause the jib 30 to be lowered with respect to the boom 10. The strut 20 is attached to the boom tip end 10*t* in a raisable and lowerable manner. The strut 20 consists of two struts, i.e., a front strut and a rear strut.

The jib 30 is a structural body for hoisting a load via a non-illustrated rope and a non-illustrated hook. The jib 30 is attached to the boom tip end 10*t*. The jib 30 is a luffing jib which is raisable and lowerable with respect to the boom 10. The jib 30 is an enfolding support-type jib. The raisable-lowerable member 6 according to this embodiment is configured such that the jib 30 can be selectively set in a protruding posture where the jib 30 extends to protrude from the boom tip end 10*t*, and an enfolded posture (see FIG. 1) where the jib 30 extends from the boom tip end 10*t* toward the base end of the boom 10 along the belly surface of the boom 10. For example, the protruding posture is a posture where the jib 30 extends to protrude from the boom tip end 10*t* forwardly and obliquely upwardly, in a state in which the boom 10 stands up during a crane work. A posture where the aftermentioned lower jib 40 of the jib 30 extends to protrude from the boom tip end 10*t*, as illustrated in FIG. 7A, also falls into the protruding posture. In the following description, an axial direction of the jib 30 will be referred to as "jib axis direction Xj". A region of the jib 30 offset toward a base end thereof in the jib axis direction Xj will be referred to as "jib base end side Xj1". That is, a region of the jib 30 offset toward an end thereof to be attached to the boom tip end 10*t* will be referred to as "jib base end side Xj1". A region of the jib 30 offset toward a tip end thereof in the jib axis direction Xj will be referred to as "jib tip end side Xj2". That is, a region of the jib 30 offset toward a side opposite to the jib base end side Xj1 in the jib axis direction Xj will be referred to as "jib tip end side Xj2". An upward-downward direction of the jib 30 in a state in which the jib 30 is set in the enfolded posture, i.e., the jib 30 is disposed under the boom 10 which has been lowered and laid down will be referred to as "jib upward-downward direction Yj". A back (reverse) surface side of the jib 30 in the jib upward-downward direction Yj, i.e., a lower side of the jib 30 in the enfolded posture, will be referred to as "jib back surface side Yj1". A belly surface side of the jib 30 in the jib upward-downward direction Yj, i.e., an upper side of the jib 30 in the enfolded posture, will be referred to as "jib belly surface side Yj2". A lateral direction of the jib 30 perpendicular to the jib axis direction Xj and the jib upward-downward direction Yj will be referred to as "jib lateral direction Zj". The jib 30 is dividable in the jib axis direction Xj. That is, the jib 30 comprises a plurality of unit jibs. Specifically, as the plurality of unit jibs, the jib 30 comprises an upper jib 31, an intermediate jib 33, an intermediate tapered jib 35, and a lower jib 40, for example. The upper jib 31, the intermediate jib 33, the intermediate tapered jib 35 and the lower jib 40 are arranged side-by-side in this order along a direction from the jib tip end side Xj2 to the jib base end side Xj1. It is to be understood that the number of the unit jibs constituting the jib 30 is not limited to four as mentioned above, but may be in the range of one to three or may be five or more.

Figure 3:
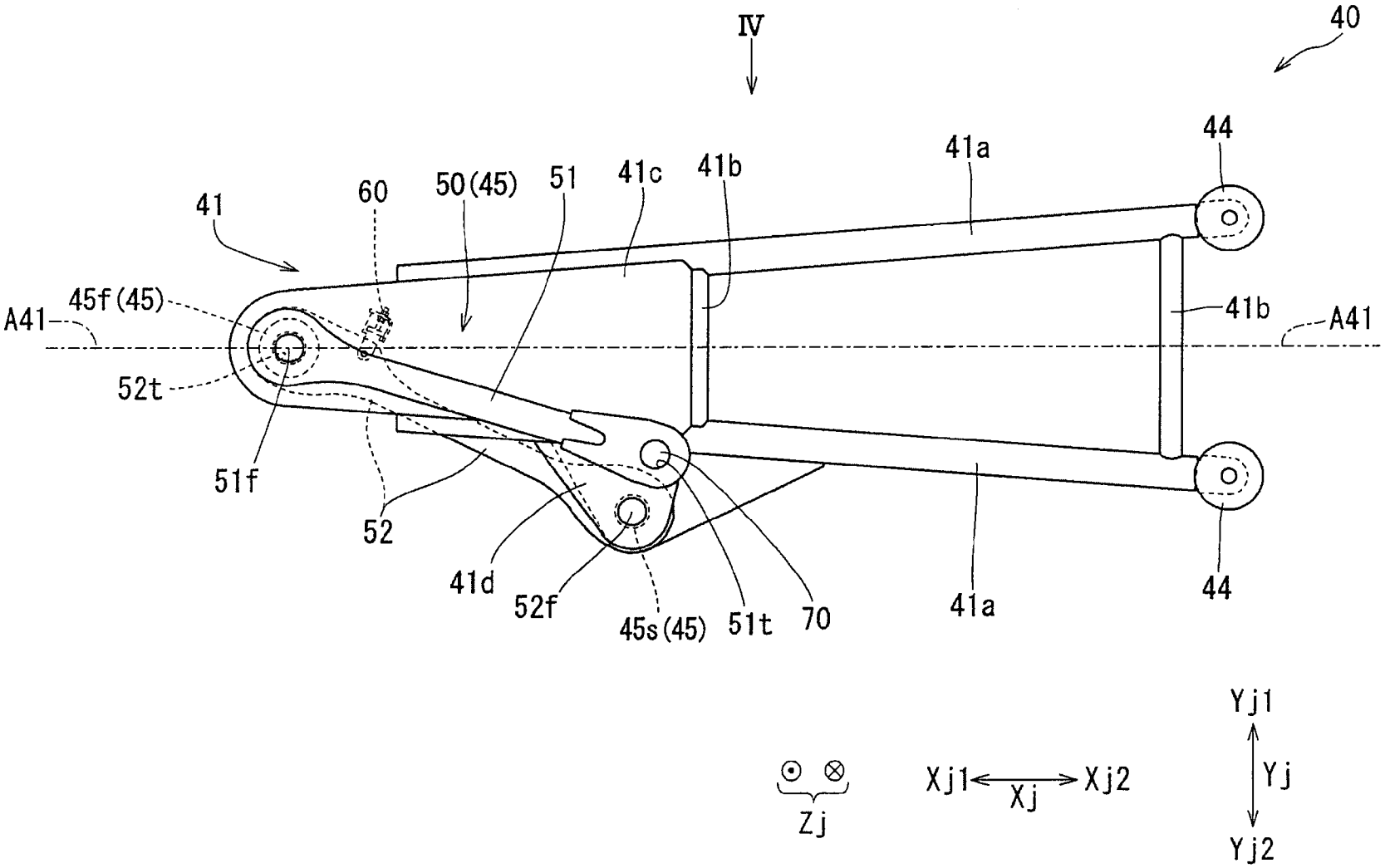
FIG. 3 is a diagram illustrating the lower jib 40 illustrated in FIG. 2.
Figure 4:
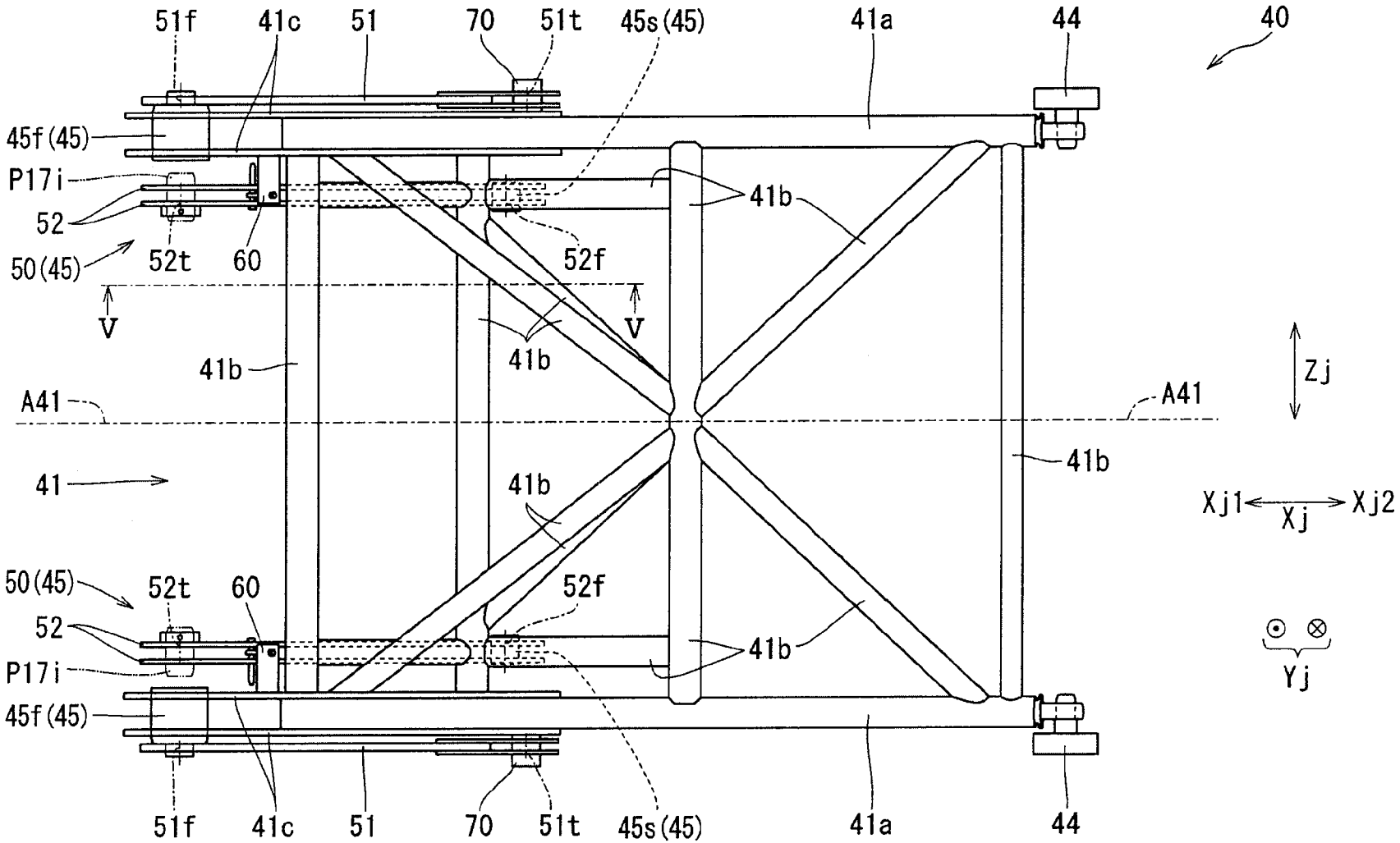
FIG. 4 is a diagram illustrating the lower jib 40, as viewed in a direction indicated by the arrowed line IV in FIG. 3.

Among a plurality of components of the jib 30 dividable in the jib axis direction Xj, the lower jib 40 is a component (unit jib) located at an endmost position on the jib base end side Xj1. As illustrated in FIG. 4, the lower jib 40 is constructed bilaterally symmetrically. That is, the lower jib 40 is constructed symmetrically in the jib lateral direction Zj. As illustrated in FIG. 3, the lower jib 40 comprises a frame 41, four rollers 44, an enfolding support mechanism 45, a pair of position adjusting and holding units 60, and a pair of outer link holding members 70.

The frame 41 is, as it were, a body of the lower jib 40. The frame 41 has an appropriately triangular prism shape. The frame 41 is formed using a pipe, a plate and others. The frame 41 comprises four main members 41*a*, a plurality of coupling members 41*b*, four plate members 41*c*, and a protruding portion 41*d*.

The four main members 41*a* are disposed, respectively, at four corners of a quadrangular cross-section of the frame 41, as viewed in the jib axis direction Xj. Each of the main members 41*a* is formed using a pipe. Each of the coupling members 41*b* is formed using a pipe. In this embodiment, an axis of the frame 41 extends in the jib axis direction Xj. The axis of the frame 41 will be referred to as "axis A41". The axis A41 is a center line passing a center of the four main members 41*a*. That is, the axis A41 passes centrally between adjacent two of the main members 41*a* in the jib upward-downward direction Yj and passes centrally between adjacent two of the main members 41*a* in the jib lateral direction Zj.

As illustrated in FIG. 4, the plurality of coupling members 41*b* comprise first coupling members each mutually coupling respective adjacent two of the main members 41*a*, second coupling members each mutually coupling one of the first coupling members and one of the main members 41*a*, and third coupling members each mutually coupling two of the first coupling members. Examples of the first coupling members include a vertical member extending in the jib upward-downward direction Yj (see FIG. 3) and a horizontal member extending in the jib lateral direction Zj (see FIG. 4). Examples of the second coupling members and the third coupling members include an oblique member extending obliquely to at least any one of the jib axis direction Xj, the jib upward-downward direction Yj and the jib lateral direction Zj.

The four plate members 41*c* support the aftermentioned jib-side jib foot 45*f* with respect to the main members 41*a*. The four plate members 41*c* are paired two-by-two. The paired two plate members 41*c* are arranged to clamp therebetween two of the main members 41*a* and one of two laterally-separated parts of the jib-side jib foot 45*f*, in the jib lateral direction Zj.

Figure 5:
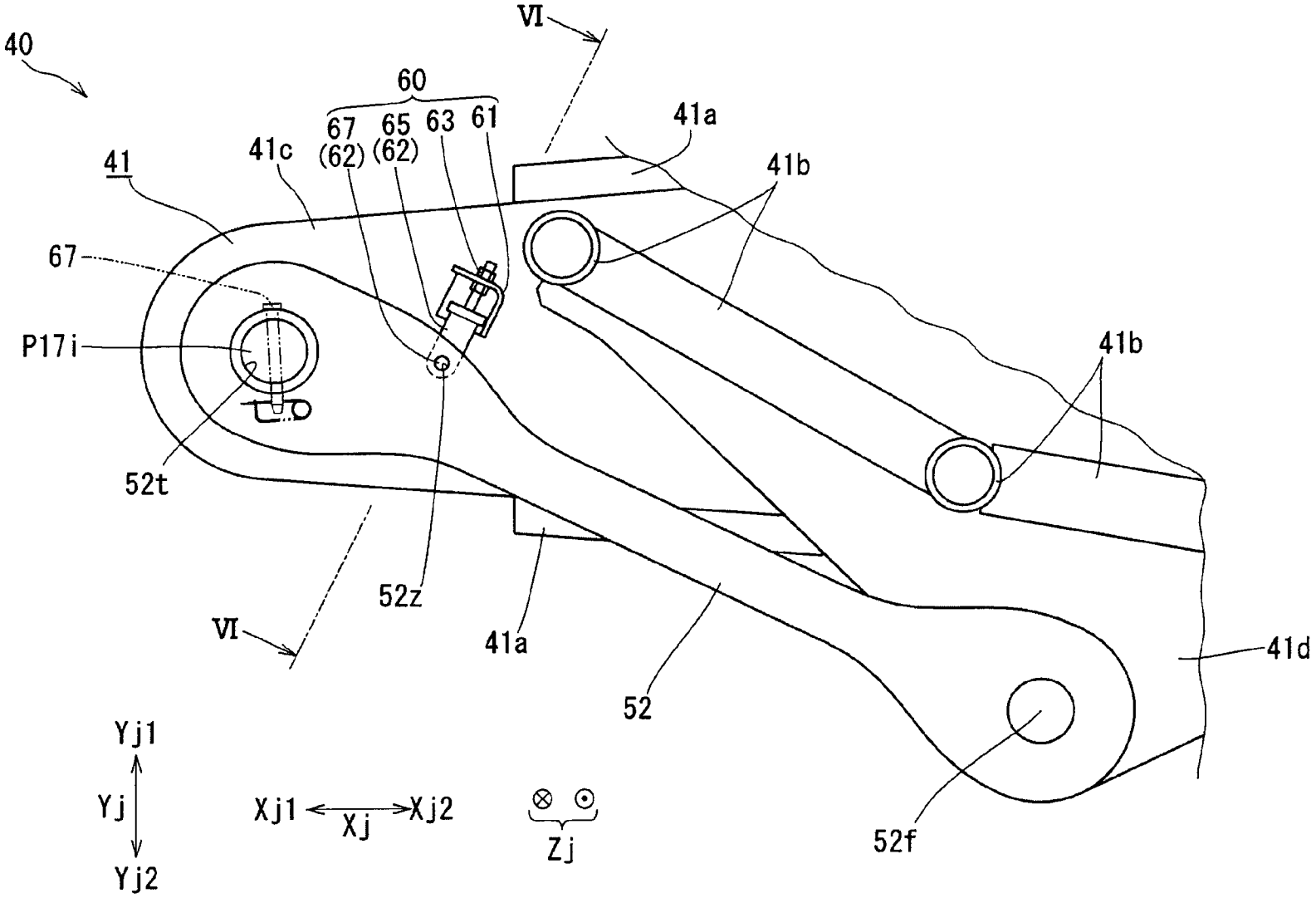
FIG. 5 is a sectional view illustrating an area around an inner link 52, taken along the line V-V in the lower jib 40 illustrated in FIG. 4.

As illustrated in FIG. 3, the protruding portion 41*d* is a mounting portion to which aftermentioned inner-link base end 52*f* are attached. The protruding portion 41*d* protrudes toward the jib belly surface side Yj2 with respect to the main members 41*a*. As illustrated in FIG. 5, the protruding portion 41*d* is fixed, for example, to one or more of the coupling members 41*b*. For example, the protruding portion 41*d* has a plate shape.

Figure 7B:
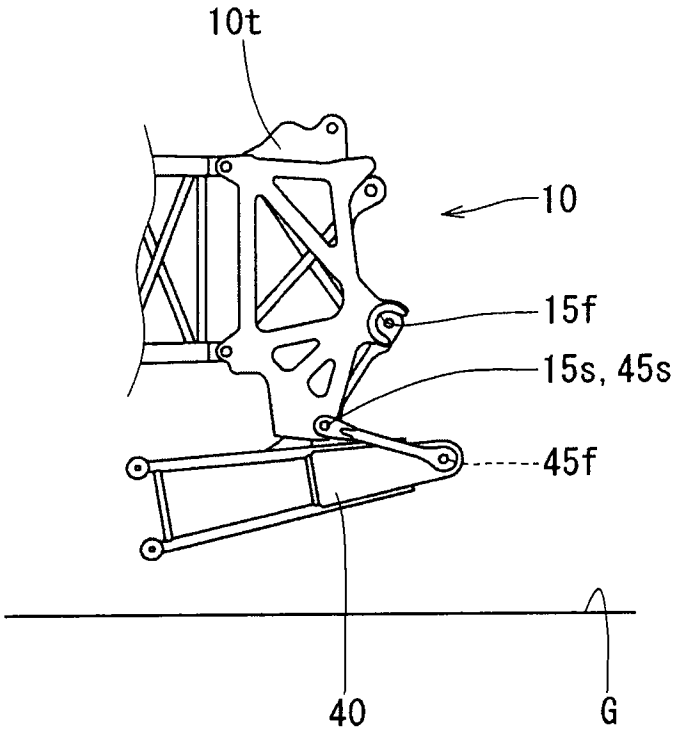
FIG. 7B is a diagram illustrating a state in which the lower jib 40 is turned over from the state illustrated in FIG. 7A.
Figure 7A:
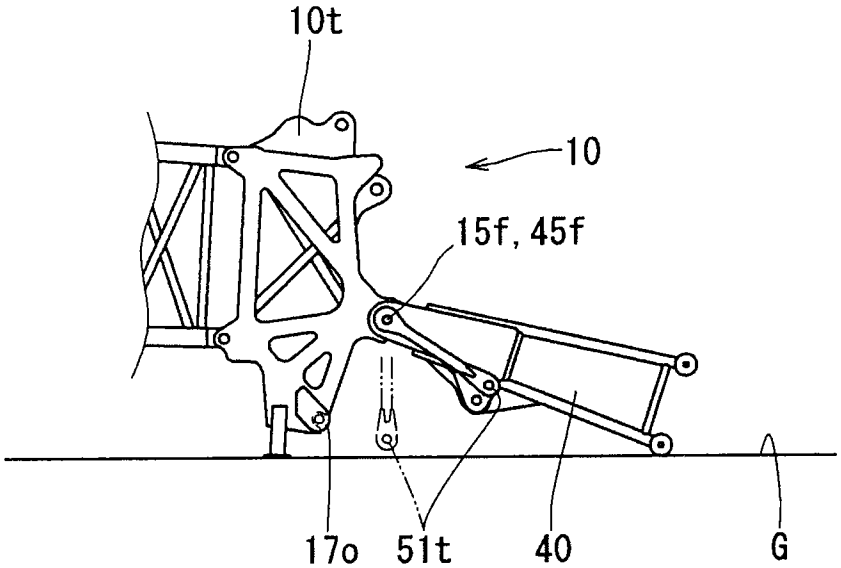
FIG. 7A is a diagram illustrating a state in which the lower jib 40 is attached to the boom tip end 10*t* illustrated in FIG. 2.

The rollers 44 are a device for facilitating turning-over of the lower jib 40 as illustrated in FIGS. 7A and 7B. The rollers 44 allows an end of the lower jib 40 on the jib tip end side Xj2 illustrated in FIG. 3 to be slidingly moved with respect to the ground G (see FIG. 7A). The rollers 44 are provided at an end of the frame 41 on the jib tip end side Xj2. The four rollers 44 are provided, respectively, at distal ends of the four main members 41*a*.

The enfolding support mechanism 45 is designed to switch between two rotational axes of the jib 30 with respect to the boom 10 (see FIG. 1), depending on a raising/lowering angle of the jib 30 with respect to the boom 10. The enfolding support mechanism 45 is, as it were, a device for folding the jib 30 with respect to the boom 10. The enfolding support mechanism 45 (see FIG. 3) comprises a jib-side jib foot 45*f*, a jib-side supporting portion 45*s*, and an enfolding link mechanism 50.

The jib-side jib foot 45*f* is designed to serve as a rotational center of the jib 30 with respect to the boom 10, in the crane 1 during a crane work or the like. The jib-side jib foot 45*f* is configured to be supported by the boom-side jib foot 15*f* in a rotatable manner with respect to the boom 10 when the jib 30 is set in the protruding posture. The jib-side jib foot 45*f* is one example of "jib foot" set forth in the appended claims. As illustrated in FIG. 2, the jib-side jib foot 45*f* is provided at one end of the frame 41 on the jib base end side Xj1. The jib-side jib foot 45*f* is configured to be attachable to the boom-side jib foot 15*f*. Specifically, the jib-side jib foot 45*f* has a columnar shape which is fittable into the U-shaped opening of the boom-side jib foot 15*f*. More specifically, the jib-side jib foot 45*f* is formed in a columnar shape having a diameter less than a width of the mouth of the opening of the boom-side jib foot 15*f* opened in the periphery thereof, so that it can be fitted into the opening through the mouth. On the other hand, in the case where the boom-side jib foot 15*f* is formed in a columnar shape, the jib-side jib foot 45*f* may be formed with a U-shaped opening capable of allowing the columnar-shaped boom-side jib foot 15*f* to be fitted thereinto. Specifically, in the case where the boom-side jib foot 15*f* is formed in a columnar shape, the jib-side jib foot 45*f* may be formed with an opening which has a mouth opened in a part of a periphery thereof with a width enough to allow the columnar-shaped boom-side jib foot 15*f* to pass therethrough.

The jib-side supporting portion 45*s* is designed to serve as a rotational center of the jib 30 with respect to the boom 10, for example, when the jib 30 is set in the enfolded posture as illustrated in FIG. 1. The jib-side supporting portion 45*s* is configured to be supported by the boom-side supporting portion 15*s* in a rotatable manner with respect to the boom 10 when the jib 30 is set in the enfolded posture. The jib-side supporting portion 45*s* is one example of "supportable portion" set forth in the appended claims. As illustrated in FIG. 2, the jib-side supporting portion 45*s* is provided in the frame 41 at a position on the jib tip end side Xj2 with respect to the jib-side jib foot 45*f*. The jib-side supporting portion 45*s* is configured to be attachable to the boom-side supporting portion 15*s*. Specifically, the jib-side supporting portion 45*s* has a columnar shape which is fittable into the U-shaped opening of the boom-side supporting portion 15*s*. More specifically, the jib-side supporting portion 45*s* is formed in a columnar shape having a diameter less than a width of the mouth of the opening of the boom-side supporting portion 15*s* opened in the periphery thereof, so that it can be fitted into the opening through the mouth. On the other hand, in the case where the boom-side supporting portion 15*s* is formed in a columnar shape, the jib-side supporting portion 45*s* may be formed with a U-shaped opening capable of allowing the boom-side supporting portion 15*s* to be fitted thereinto. Specifically, in the case where the boom-side supporting portion 15*s* is formed in a columnar shape, the jib-side supporting portion 45*s* may be formed with an opening which has a mouth opened in a part of a periphery thereof with a width enough to allow the columnar-shaped boom-side supporting portion 15*s* to pass therethrough.

The enfolding link mechanism 50 is designed to mutually couple the lower jib 40 and the boom tip end 10*t*. The enfolding link mechanism 50 comprises a plurality of rod-shaped or plate-shaped link members. Specifically, the enfolding link mechanism 50 comprises a pair of outer links 51, and a pair of inner links 52. Each of the outer links 51 is one example of "first link" set forth in the appended claims, and each of the inner links 52 is one example of "second link" set forth in the appended claims.

As illustrated in FIG. 4, each of the pair of outer links 51 is provided respective outer sides of two sets of the two main members 41*a* on opposite sides of the frame 41 symmetrically in the jib lateral direction Zj. As illustrated in FIG. 3, each of the outer links 51 is attached to the frame 41 in a rotatable manner with respect to the frame 41. Each of the outer links 51 has an outer-link base end 51*f* and an outer-link distal end 51*t*. In FIG. 4, each of a central axis of the outer-link base end 51*f* and a central axis of the outer-link distal end 51*t* is designated by a corresponding reference code. This also applies to aftermentioned inner-link base end 52*f* and inner-link distal end 52*t*. The central axis corresponds to a central axis of a pin or a central axis of a pin hole.

The outer-link base end 51*f* is one of longitudinal ends of the outer link 51, and is designed to serve as a rotational center of the outer link 51 with respect to the frame 41 (see FIG. 3). The outer-link base end 51*f* is disposed in concentric relation to the jib-side jib foot 45*f*. That is, the outer links 51 are coupled to the frame 41 in a rotatable manner about an axis coincident with a rotational axis of the jib-side jib foot 45*f*. The rotational axis of the outer links 51 is one example of "first axis" set forth in the appended claims. A direction along which the rotational axis of the outer links 51 extends is coincident with the jib lateral direction Zj.

The outer-link distal end 51*t* is the other end of the outer link 51 on a side opposite to the outer-link base end 51*f*. That is, the outer-link distal end 51*t* is provided at a position away from the rotational axis of the outer links 51. The outer-link distal end 51*t* is configured to be detachably joined to the outer-link mounting bracket 17*o* of the boom 10 (see FIG. 7A). The outer-link distal end 51*t* is one example of "first joint portion" set forth in the appended claims. The outer-link distal end 51*t* has a pin hole. The outer-link distal end 51*t* is configured to be attached to the outer-link mounting bracket 17*o* through a pin. That is, the outer-link distal end 51*t* can be attached to the outer-link mounting bracket 17*o* by positioning the pin hole of the outer-link distal end 51*t* in such a manner as to be concentric with the pin hole of the outer-link mounting bracket 17*o*, and then fittingly inserting a pin into the pin holes.

As illustrated in FIG. 4, each of the pair of inner links 52 is disposed respective inner sides of the opposite ends of the frame 41 symmetrically in the jib lateral direction Zj. Specifically, each of the inner links 52 is provided respective inner sides of the two sets of the two main members 41*a* on the opposite sides of the frame 41 in the jib lateral direction Zj. For example, each of the inner links 52 comprises two plates. As illustrated in FIG. 5, each of the inner links 52 is attached to the frame 41 in a rotatable manner with respect to the frame 41. Each of the inner links 52 has an inner-link base end 52*f*, an inner-link distal end 52*t*, and a position adjusting and holding pin hole 52*z*.

The inner-link base end 52*f* is one of longitudinal ends of the inner link 52, and is designed to serve as a rotational center of the inner link 52 with respect to the frame 41. As illustrated in FIG. 3, the inner-link base end 52*f* is disposed in concentric relation to the jib-side supporting portion 45*s*. That is, the inner links 52 are coupled to the protruding portion 41*d* of the frame 41 in a rotatable manner about an axis coincident with a rotational axis of the jib-side supporting portion 45*s*. The rotational axis of the inner links 52 is one example of "second axis" set forth in the appended claims. A direction along which the rotational axis of the inner links 52 extends is coincident with the jib lateral direction Zj.

The inner-link base end 52*f* is disposed so as to make it easier to arrange the coupling members 41*b* (see FIGS. 3 and 4) of the frame 41. Specifically, as viewed in the jib lateral direction Zj, the inner-link base end 52*f* is offset from the axis A41 of the frame 41 toward the jib belly surface side Yj2. In other words, as viewed in the jib lateral direction Zj, the inner-link base end 52*f* is disposed to be offset from the axis A41 toward the jib belly surface side Yj2. For example, the inner-link base end 52*f* is disposed farther toward the jib belly surface side Yj2 than one of the main members 41*a* of the frame 41 located on the jib belly surface side Yj2. That is, the rotational axis of the inner links 52 is offset from the axis A41 of the frame 41 toward the jib belly surface side Yj2, as viewed in the jib lateral direction Zj, more specifically, located farther toward the jib belly surface side Yj2 than two of the main members 41*a* located on the jib belly surface side Yj2.

The inner-link distal end 52*t* (see FIGS. 3 and 5) is the other end of the inner link 52 on a side opposite to the inner-link base end 52*f*. That is, the inner-link distal end 52*t* is provided at a position away from the rotational axis of the inner links 51. The inner-link distal end 52*t* is one example of "second joint portion" set forth in the appended claims. The inner-link distal end 52*t* is configured to be detachably joined to the inner-link mounting bracket 17*i* of the boom 10 illustrated in FIG. 2. That is, the inner-link mounting bracket 17*i* is configured to detachably support the inner-link distal end 52*t*. The inner-link mounting bracket 17*i* is also configured to support the inner-link distal end 52*t* in such a manner as to allow the inner-link distal end 52*t* to be rotated about an axis coincident with the rotational axis of the jib-side jib foot 45*f* being supported by the boom-side jib foot 15*f*. The inner-link distal end 52*t* has a pin hole. The inner-link distal end 52*t* (see FIGS. 3 and 5) is configured to be attached to the inner-link mounting bracket 17*i* through an inner-link mounting pin P17*i* (see FIG. 4). That is, the inner-link distal end 52*t* can be attached to the inner-link mounting bracket 17*i* by positioning the pin hole of the inner-link distal end 52*t* in such a manner as to be concentric with the pin hole of the inner-link mounting bracket 17*i*, and then fittingly inserting the inner-link mounting pin P17*i* into the pin holes.

As illustrated in FIG. 5, the position adjusting and holding pin hole 52*z* is designed to allow an aftermentioned position adjusting and holding pin 67 of each of the position adjusting and holding units 60 to be inserted thereinto.

Each of the pair of position adjusting and holding units 60 is a section (device, member or mechanism) for adjusting and holding a relative position of a respective one of the inner links 52 with respect to the frame 41. The position adjusting and holding units 60 are coupled, respectively, to the pair of inner links 52 arranged on the opposite sides of the frame 41 separately in the jib lateral direction Zj. Each of the position adjusting and holding units 60 is configured to couple, to the frame 41, a given site of a respective one of the inner links 52 away from the rotational axis of the inner links 52, in such a manner that a relative position of the inner link 52 with respect to the frame 41 in a rotational direction of the inner link 52 is adjustably changed to allow the rotational axis of the inner-link distal end 52*t* to become coincident with the rotational axis of the jib-side jib foot 45*f*. Specifically, as illustrated in FIG. 4, each of the position adjusting and holding units 60 is configured to couple a portion of a respective one of the inner links 52 adjacent to the inner-link distal end 52*t* thereof, to a portion of the frame 41 adjacent to the jib-side jib foot 45*f*. The position adjusting and holding unit 60 is also configured to hold the inner link 52 at the changed relative position. As illustrated in FIG. 5, each of the position adjusting and holding units 60 comprises a frame-fixed member 61, an inner link-attached member 62, and a screw mechanism 63.

Figure 6:
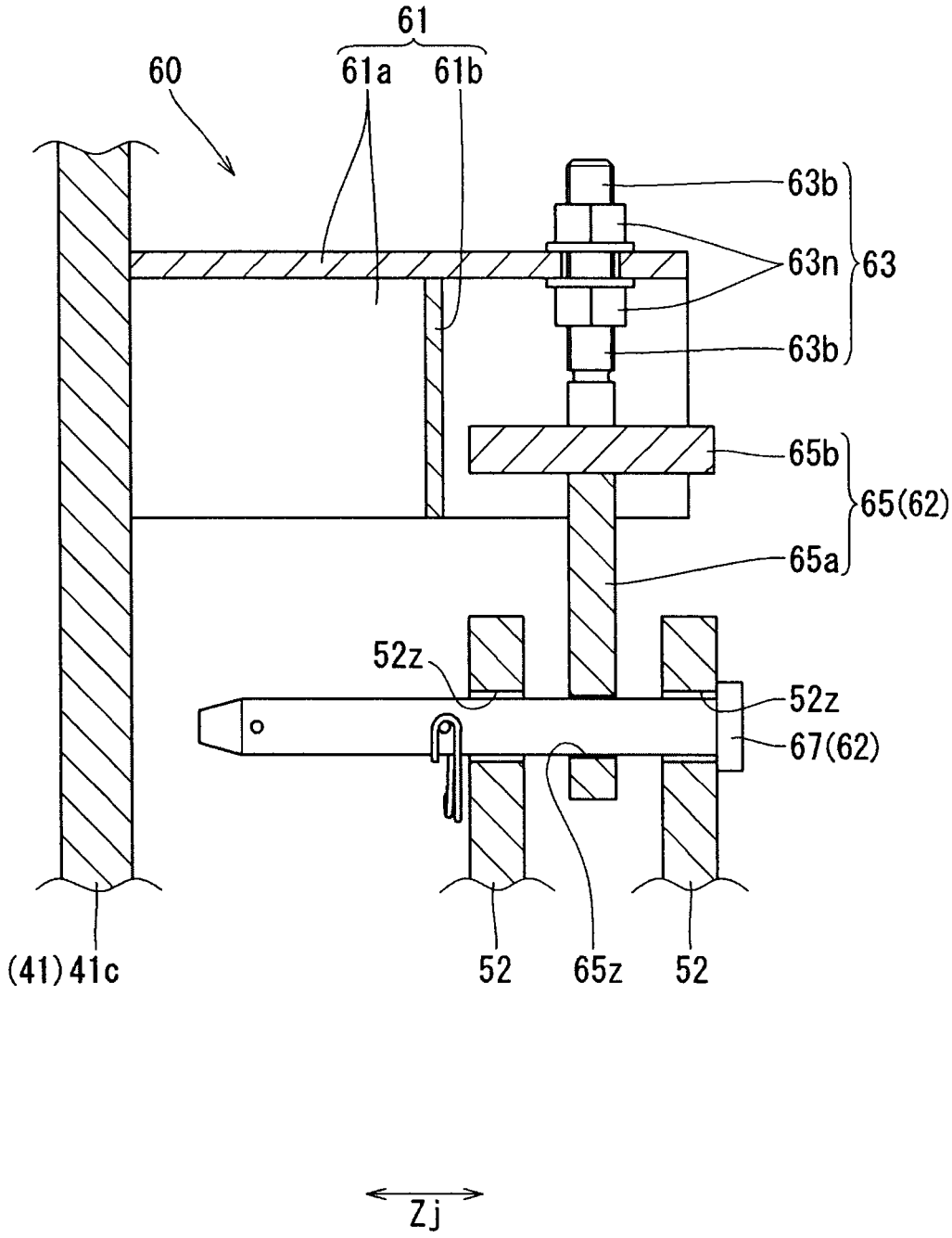
FIG. 6 is a sectional view illustrating a position adjusting and holding unit, taken along the line VI-VI in the lower jib 40 in FIG. 5.

The frame-fixed member 61 is one example of "first attachment portion" set forth in the appended claims. As illustrated in FIG. 6, the frame-fixed member 61 is fixed to the frame 41. Specifically, the frame-fixed member 61 is fixed to an inner one of the pair of plate members 41*c* of the frame 41. The frame-fixed member 61 protrudes from the inner plate member 41*c* toward the inner link 52 (toward an inner side of the frame 41 in the jib lateral direction Zj). For example, the frame-fixed member 61 is composed of a combination of a plurality of plates. Specifically, the frame-fixed member 61 comprises an angle member 61*a* composed of a bent plate, and a reinforcement plate 61*b* reinforcing the angle member 61*a*. The angle member 61*a* is fixed to the inner plate member 41*c*.

The inner link-attached member 62 is one example of "second attachment portion" set forth in the appended claims. The inner link-attached member 62 is attached to the specific site of the inner link 52. The inner link-attached member 62 comprises a rod 65 and a position adjustment and holding pin 67.

The rod 65 is attached to the specific site of the inner link 52 through the position adjustment and holding pin 67. For example, the rod 65 is composed of a combination of a first plate 65*a* a second plate 65*b*. The first plate 65*a* is formed with a rod-side pin hole 65*z*. The first plate 65*a* is disposed between the two plates of the inner link 52. An aftermentioned bolt 63*b* is fixed to the second plate 65*b*.

The position adjustment and holding pin 67 is inserted into the rod-side pin hole 65*z* of the rod 65 and the position adjusting and holding pin hole 52*z* provided at the specific site of the inner link 52, thereby coupling the rod 65 to the inner link 52. The position adjustment and holding pin 67 is disposed to allow an axial direction of the position adjustment and holding pin 67 to become coincident with the jib lateral direction Zj, so that the position adjustment and holding pin 67 can restrict a rotation of the inner link 52 with respect to the frame 41. The position adjustment and holding pin 67 can also be attached to the inner-link mounting pin P17*i* as indicated by the two-dot chain line in FIG. 5, and used as a retaining pin for the inner-link mounting pin P17*i*.

The screw mechanism 63 is designed to adjust and hold a position of the inner link 52 with respect to the frame 41. Specifically, the screw mechanism 63 is configured to mutually couple the frame-fixed member 61 fixed to the frame 41 and the inner link-attached member 62 attached to the inner link 52, in such a manner as to allow a distance between the frame-fixed member 61 and the inner link-attached member 62 in a rotational direction of the inner link 52 to be changed. The screw mechanism 63 is configured to hold the distance between the frame-fixed member 61 and the inner link-attached member 62, at the changed distance. The screw mechanism 63 is coupled to the frame 41 through the frame-fixed member 61, and coupled to the inner links 52 through the inner link-attached member 62. The screw mechanism 63 comprises a bolt 63*b* and two nuts 63*n*. The bolt 63*b* is fixed to the rod 65 while penetrating through the frame-fixed member 61. The two nuts 63*n* are attached to the bolt 63*b*. The two nuts 63*n* are tightened from opposite sides of the frame-fixed member 61 to fix the bolt 63*b* to the frame-fixed member 61.

As illustrated in FIGS. 3 and 4, each of the pair of outer-link holding members 70 is configured to couple a respective one of the outer links 51 to the frame 41 and hold the outer link 51 with respect to the frame 41. Specifically, each of the outer-link holding members 70 is configured to hold the outer link 51 at a specific relative position to the frame 41 in the rotational direction of the outer link 51. Each of the outer-link holding members 70 is one example of "first-link holding member" set forth in the appended claims. The outer-link holding member 70 is configured to mutually couple a side surface of the frame 41 and the outer-link distal end 51*t*. Specifically, the outer-link holding member 70 is configured to couple an outer surface of the frame 41 in the jib lateral direction Zj, and the outer-link distal end 51*t*. For example, the outer-link holding member 70 comprises a pin which is attached to the outer surface of the frame 41 and insertable into the pin hole of the outer-link distal ends 51*t*. When the pin of the outer-link holding member 70 is inserted into the pin hole of the outer-link distal ends 51*t*, the outer-link distal ends 51*t* is coupled to the frame 41 through the outer-link holding member 70, so that a rotation of the outer link 51 with respect to the frame 41 is inhibited, and a relative position of the outer link 51 with respect to the frame 41 is fixed.

(Method for Transportation of Lower Jib 40)

The lower jib 40 illustrated in FIG. 3 is transported by the following first or second transportation method.

[First Transportation Method]

In a first transportation method, the lower jib 40 is transported in a state in which the frame 41 and the enfolding link mechanism 50 (the inner links 52 and the outer links 51) are coupled (united) together. The first transportation method makes it possible to eliminate a need for an operation of attaching and detaching the outer links 51 and the inner links 52 with respect to the frame 41.

[Second Transportation Method]

In a second transportation method, the lower jib 40 is transported in a state in which a relative position of each of the outer links 51 and the inner links 52 with respect to the frame 41 is fixed so as to prevent each of the outer links 51 and the inner links 52 from rotating with respect to the frame 41. The relative position of each of the outer links 51 with respect to the frame 41 is fixed by a respective one of the outer-link holding members 70. The relative position of each of the inner links 52 with respect to the frame 41 is fixed by a respective one of the position adjusting and holding units 60.

(Method for Attachment of Lower Jib 40 to Boom 10)

A method of attaching the lower jib 40 to the boom 10 (see FIG. 2) will be described below, according to a process sequence. This attachment method comprises a position adjustment step, a jib-foot insertion step, an inner-link coupling step, an outer-link coupling step, a lower-jib turning-over step, and other steps. The operation of attaching the lower jib 40 to the boom 10 is performed in the laid-down state of the boom 10 as illustrated in FIG. 1.

[Position Adjustment Step]

In the position adjustment step, a position of each of the inner links 52 with respect to the frame 41 is adjusted by a respective one of the position adjusting and holding units 60 illustrated in FIG. 3. Specifically, the position of each of the inner links 52 with respect to the frame 41 in the rotational direction of the inner link 52 is adjusted and held by a respective one of the position adjusting and holding units 60, in such a manner as to allow a position of the central axis of the pin hole of the inner-link distal end 52*t* to become coincident with a position of the rotational axis of the jib-side jib foot 45*f*. Specifically, positions of the nuts 63*n* with respect to the bolt 63*b* illustrated in FIG. 6 are adjusted to adjust a position of the inner-link distal end 52*t* illustrated on FIG. 5, approximately in the jib upward-downward direction Yj.

[Jib-Foot Insertion Step]

In the jib-foot insertion step, the lower jib 40 is hoisted by an auxiliary crane illustrated in FIG. 2, and, in the hoisted state, the jib-side jib foot 45*f* is attached to the boom-side jib foot 15*f*. Specifically, the columnar-shaped jib-side jib foot 45*f* is fitted into the U-shaped opening of the boom-side jib foot 15*f*. The attached state is illustrated in FIG. 7A.

As a result of the jib-foot insertion step, the pin hole of the inner-link distal end 52*t* and the pin hole of the inner-link mounting bracket 17*i* (see FIG. 2) are concentrically positioned. In other words, the position adjustment step is performed to allow the pin hole of the inner-link distal end 52*t* to become concentric with the pin hole of the inner-link mounting bracket 17*i*. Alternatively, the jib-foot insertion step may be performed after completion of the jib-foot insertion step.

[Inner-Link Coupling Step]

In the inner-link coupling step, as illustrated in FIG. 4, the pin hole of the inner-link distal end 52*t* and the pin hole of the inner-link mounting bracket 17*i* (see FIG. 2) are coupled together through the inner-link mounting pin P17*i*. Then, the position adjustment and holding pin 67 is extracted from the position adjusting and holding pin hole 52*z*. The extracted position adjustment and holding pin 67 is attached to the inner-link mounting pin P17*i* as indicated by the two-dot chain line in FIG. 5, and used as a retaining pin for the inner-link mounting pin P17*i*.

[Outer-Link Coupling Step]

In the outer-link coupling step, the outer-link holding member 70 (*pin*) illustrated in FIG. 3 is detached from each of the outer links 51. Subsequently, using a non-illustrated auxiliary crane or the like, each of the outer links 51 is rotated about the outer-link base end 51*f* thereof, as illustrated in FIG. 7A. Then, the outer-link distal end 51*t* and the outer-link mounting bracket 17*o* are coupled together through a pin.

[Lower-Jib Turning-Over Step]

In the lower-jib turning-over step, the lower jib 40 disposed on the tip end of the boom 10 as illustrated in FIG. 7A is turned over toward the base end of the boom 10 as illustrated in FIG. 7B. In this process, a rotational axis of the lower jib 40 with respect to the boom 10 is switched from an axis of the boom-side jib foot 15*f* and the jib-side jib foot 45*f*, to an axis of the boom-side supporting portion 15*s* and the jib-side supporting portion 45*s*.

[Other Steps]

After completion of the lower-jib turning-over step, the jib 30 (see FIG. 1) is assembled. Specifically, the intermediate tapered jib 35 is coupled to the lower jib 40. Then, the intermediate jib 33 is coupled to the intermediate tapered jib 35, and the upper jib 31 is coupled to the intermediate jib 33. Subsequently, the boom 10 is raised. Then, the jib 30 is raised by the strut 20. In this process, a rotational axis of the jib 30 with respect to the boom 10 is switched from an axis of the supporting portions 15*s*, 45*s* illustrated in FIG. 7B, to an axis of the jib feet 15*f*, 45*f* illustrated in FIG. 7A. In this way, the crane 1 illustrated in FIG. 1 is set in a state capable of a crane work. That is, the jib 30 is set in a workable state.

Next, advantageous effects of the raisable-lowerable member 6 according to the above embodiment will be described.

Advantageous Effect 1

The lower jib 40 is an enfolding support-type jib configured to be attached to the boom 10 in a rotatable manner about the jib feet 15*f*, 45*f* illustrated in FIG. 7A or the supporting portions 15*s*, 45*s* illustrated in FIG. 7B. As illustrated in FIG. 3, the lower jib 40 comprises: the frame 41; the pair of outer links 51 configured to be coupled to the frame 41 in a rotatable manner about an axis coincident with the rotational axis of the jib-side jib foot 45*f* and each having the outer-link distal end 51*t* attachable and detachable to the boom 10 (see FIG. 2); the pair of inner links 52 configured to be coupled to the frame 41 in a rotatable manner about an axis coincident with a rotational axis of the jib-side supporting portion 45*s* and each having the inner-link distal end 52*t* attachable and detachable to the boom 10 (see FIG. 2); and the pair of position adjusting and holding units 60 illustrated in FIG. 5.

Each of the position adjusting and holding units 60 is configured to couple, to the frame 41, a specific site of a respective one of the inner links 52 away from the rotational axis thereof, in such a manner that a relative position of the inner link 52 with respect to the frame 41 in a rotational direction of the inner link 52 is adjustably changed to allow the rotational axis of the inner-link distal end 52*t* to become coincident with the rotational axis of the jib-side jib foot 45*f*, and to hold the inner link 52 at the changed relative position. The raisable-lowerable member 6 according to the above embodiment is provided with the above position adjusting and holding units 60. This eliminates a need for an auxiliary crane or its equivalent means for adjusting and holding the relative position of each of the inner links 52 with respect to the frame 41. Thus, it becomes possible to readily perform an operation of attaching, to the boom 10 (see FIG. 2), the inner links 52 each rotatable about an axis coincident with the rotational axis of the jib-side supporting portion 45*s* illustrated in FIG. 3. That is, assemblability between each of the inner links 52 and the boom 10 can be enhanced.

Advantageous Effect 2

As illustrated in FIG. 5, the position adjusting and holding unit 60 comprises the screw mechanism 63 configured to mutually couple the frame-fixed member 61 attached to the frame 41 and the inner link-attached member 62 attached to the inner link 52, in such a manner as to allow a distance between the frame-fixed member 61 and the inner link-attached member 62 to be changed. The screw mechanism 63 having above feature makes it possible to readily and reliably adjust and hold the relative position of the inner link 52 with respect to the frame 41 in the rotational direction of the inner link 52.

Advantageous Effect 3

As illustrated in FIG. 4, each of the inner links 52 is disposed respective inner sides of the opposite ends of the frame 41 in the jib lateral direction Zj. As illustrated in FIG. 3, as viewed in the jib lateral direction Zj, the rotational axis (of the inner-link base end 52*f*) of the inner link 52 with respect to the frame 41 is offset from the axis A41 of the frame 41 extending in the jib axis direction Xj.

This feature makes it possible to suppress interference between the inner link 52 illustrated in FIG. 3, and inner members of the frame 41, specifically, the coupling members 41*b* located inner sides of the main members 41*a* in the jib lateral direction Zj illustrated in FIG. 4.

Thus, it is unnecessary to shorten the inner link 52 due to a need for avoiding the interference between the inner link 52 and the inner members of the frame 41. Consequently, a length of the inner link 52 can be ensured. A length of the outer link 51 can also be ensured. Therefore, it becomes easier to ensure a distance between the jib foot (15*f*, 45*f*) and the supporting portion (15*s*, 45*s*). This makes it possible to set the boom-side jib foot 15*f* illustrated in FIG. 2 at a position closer to the central axis of the boom 10. As a result, it becomes possible to suppress a bending moment which would otherwise be produced in the boom 10 by a force applied from the jib 30 to the boom 10, so that it is possible to more easily enhance a hoisting ability of the boom 10, i.e., a hoisting ability of the crane 1.

In addition, the capability of suppressing the interference between the inner link 52 and the inner coupling members 41*b* of the frame 41 makes it possible to suppress restriction on layout of the coupling members 41*b*, such as arrangement and the number of the coupling members 41*b*, due to the inner link 52. Therefore, it becomes easier to adequately provide the coupling members 41*b* to thereby ensure strength of the lower jib 40.

Advantageous Effect 4

The lower jib 40 comprises the pair of outer-link holding members 70 each configured to couple the frame 41 and a respective one of the outer links 51, and hold the outer link 51 at a specific relative position to the frame 41 in the rotational direction of the outer link 51. Further, as mentioned in (Advantageous Effect 1), the relative position of the inner link 52 with respect to the frame 41 in the rotational direction of the inner link 52 is held by the position adjusting and holding unit 60. That is, it is possible to hold both of the relative positions of the outer links 51 and the inner link 52 with respect to the frame 41. Thus, it becomes easier to transport the lower jib 40 in a state the outer links 51 and the inner links 52 are coupled to the frame 41, i.e., the outer links 51 and the inner links 52 are united with the frame 41.

Modifications

The above embodiment may be variously modified. For example, the outer link 51 as the first link may be disposed inner side of the frame 41 in the jib lateral direction Zj. That is, the outer link 51 may be disposed respective inner sides of the main members 41*a* in the jib lateral direction Zj. Further, for example, the inner link 52 as the second link may be disposed outer side of the frame 41 in the jib lateral direction Zj. That is, the inner link 52 may be disposed respective outer sides of the main members 41*a* in the jib lateral direction Zj.

Outline of Embodiment

The above embodiment will be outlined as follows.

The raisable-lowerable member according to the above embodiment is designed to be provided in a construction machine. The raisable-lowerable member comprises a boom, and a jib attachable to a tip end of the boom. The jib comprises: a frame; a jib foot provided at one end of the frame constituting a base end of the jib, and configured to be supported by the boom in a rotatable manner with respect to the boom when the jib is set in a protruding posture where it protrudes from the tip end of the boom; a supportable portion provided in the frame, and configured to be supported by the boom in a rotatable manner with respect to the boom when the jib is set in an enfolded posture where it extends from the tip end of the boom toward a base end of the boom along a belly surface of the boom; a first link coupled to the frame in a rotatable manner about a first axis coincident with a rotational axis of the jib foot; a second link coupled to the frame in a rotatable manner about a second axis coincident with a rotational axis of the supportable portion; and a position adjusting and holding unit for adjusting a relative position of the second link with respect to the frame. The first link has a first joint portion which is provided at a position away from the rotational axis of the first link and is attachable and detachable with respect to the boom, and the second link has a second joint portion which is provided at a position away from the rotational axis of the second link, and is attachable and detachable with respect to the boom. The boom comprises: a first supporting portion provided at the tip end of the boom, and configured to rotatably support the jib foot when the jib is set in the protruding posture; a second supporting portion provided at a position away from the first supporting portion and toward the belly surface of the boom, and configured to rotatably support the supportable portion when the jib is set in the enfolded posture; and a third supporting portion configured to detachably support the second joint portion in such a manner as to allow the second joint portion to be rotated about an axis coincident with the rotational axis of the jib foot being supported by the first supporting portion. The position adjusting and holding unit is configured to couple, to the frame, a specific site of the second link away from the second axis, in such a manner that a relative position of the second link with respect to the frame in a rotational direction of the second link is adjustably changed to allow the rotational axis of the second joint portion to become coincident with the rotational axis of the jib foot, and to hold the second link at the changed relative position.

In the above raisable-lowerable member, the position adjusting and holding unit may comprise: a first attachment portion attached to the frame; a second attachment portion attached to the specific site of the second link; and a screw mechanism configured to mutually couple the first attachment portion and the second attachment portion in such a manner as to allow a distance between the first attachment portion and the second attachment portion to be changed.

In the above raisable-lowerable member, the second link may be disposed respective inner sides of opposite ends of the frame, in a lateral direction of the jib coincident with a direction along which the second axis extends, wherein the second axis may be offset from an axis of the frame extending in an axial direction of the jib, as viewed in the lateral direction of the jib.

In the above raisable-lowerable member, the jib may further comprise a first-link holding member configured to hold the first link at a specific relative position to the frame in a rotational direction of the first link.

The raisable-lowerable member according to the above embodiment is capable of making it easier to perform an operation of attaching, to a boom, the second link rotatable about an axis coincident with the rotational axis of the supportable portion of the jib.

This application is based on Japanese Patent application No. 2013-055367 filed in Japan Patent Office on Mar. 18, 2013, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. A raisable-lowerable member designed to be provided in a construction machine, comprising a boom, and a jib attachable to a tip end of the boom, wherein the jib comprises:

a frame;

a jib foot provided at one end of the frame constituting a base end of the jib, and configured to be supported by the boom in a rotatable manner with respect to the boom when the jib is set in a protruding posture where it protrudes from the tip end of the boom;

a supportable portion provided in the frame, and configured to be supported by the boom in a rotatable manner with respect to the boom when the jib is set in an enfolded posture where it extends from the tip end of the boom toward a base end of the boom along a belly surface of the boom;

a first link coupled to the frame in a rotatable manner about a first axis coincident with a rotational axis of the jib foot;

a second link coupled to the frame in a rotatable manner about a second axis coincident with a rotational axis of the supportable portion; and a position adjusting and holding unit for adjusting a relative position of the second link with respect to the frame, and wherein the first link has a first joint portion which is provided at a position away from the rotational axis of the first link and is attachable and detachable with respect to the boom, and the second link has a second joint portion which is provided at a position away from the rotational axis of the second link, and is attachable and detachable with respect to the boom, and wherein the boom comprises:

a first supporting portion provided at the tip end of the boom, and configured to rotatably support the jib foot when the jib is set in the protruding posture;

a second supporting portion provided at a position away from the first supporting portion and toward the belly surface of the boom, and configured to rotatably support the supportable portion when the jib is set in the enfolded posture; and a third supporting portion configured to detachably support the second joint portion in such a manner as to allow the second joint portion to be rotated about an axis coincident with the rotational axis of the jib foot being supported by the first supporting portion, and wherein the position adjusting and holding unit is configured to couple, to the frame, a specific site of the second link away from the second axis, in such a manner that a relative position of the second link with respect to the frame in a rotational direction of the second link is adjustably changed to allow the rotational axis of the second joint portion to become coincident with the rotational axis of the jib foot, and to hold the second link at the changed relative position.

2. The raisable-lowerable member as defined in claim 1, wherein the position adjusting and holding unit comprises:

a first attachment portion attached to the frame;

a second attachment portion attached to the specific site of the second link; and a screw mechanism configured to mutually couple the first attachment portion and the second attachment portion in such a manner as to allow a distance between the first attachment portion and the second attachment portion to be changed.

3. The raisable-lowerable member as defined in claim 2, wherein the second link is disposed respective inner sides of opposite ends of the frame in a lateral direction of the jib coincident with a direction along which the second axis extends, and wherein the second axis is offset from an axis of the frame extending in an axial direction of the jib, as viewed in the lateral direction of the jib.

4. The raisable-lowerable member as defined in claim 2, wherein the jib further comprises a first-link holding member configured to hold the first link at a specific relative position to the frame in a rotational direction of the first link.

5. The raisable-lowerable member as defined in claim 1, wherein the second link is disposed respective inner sides of opposite ends of the frame in a lateral direction of the jib coincident with a direction along which the second axis extends, and wherein the second axis is offset from an axis of the frame extending in an axial direction of the jib, as viewed in the lateral direction of the jib.

6. The raisable-lowerable member as defined in claim 5, wherein the jib further comprises a first-link holding member configured to hold the first link at a specific relative position to the frame in a rotational direction of the first link.

7. The raisable-lowerable member as defined in claim 1, wherein the jib further comprises a first-link holding member configured to hold the first link at a specific relative position to the frame in a rotational direction of the first link.

* * * * *